United States Patent [19]

Judge, Jr.

[11] Patent Number: 4,470,623

[45] Date of Patent: Sep. 11, 1984

[54] PLATE FASTENING SYSTEM

[75] Inventor: James H. Judge, Jr., Merrimac, Mass.

[73] Assignee: Cargocaire Engineering Corp., Amesbury, Mass.

[21] Appl. No.: 404,340

[22] Filed: Jul. 30, 1982

[51] Int. Cl.[3] ..... E05C 5/04

[52] U.S. Cl. ..... 292/58; 292/256.75

[58] Field of Search ..... 292/58, 62, 256.75, 292/246, 248, 249, 250, 257, 260

[56] References Cited

U.S. PATENT DOCUMENTS

| | | | |
|---|---|---|---|
| 1,008,146 | 11/1911 | Herriman | 292/256.75 X |
| 2,324,356 | 7/1943 | Brown | 292/257 X |
| 3,666,134 | 5/1972 | Rauch | 292/256.75 X |

*Primary Examiner*—Richard E. Moore

*Attorney, Agent, or Firm*—Curtis, Morris & Safford

[57] ABSTRACT

A fastening system is provided for fastening a plate having open-ended slots formed about its periphery to a supporting wall. The system includes a mounting block which is mounted to the supporting wall, a clevis pivoted on the mounting block, the clevis having a main body portion and two legs extending in the same direction from opposite sides of the main body portion with an elongated opening formed in each leg, a roll pin which extends through the elongated openings and into openings formed on opposite sides of the mounting block, and a slotted binder head machine screw which extends into an opening formed in the main body portion of the clevis and which cooperates with the U-shaped slots formed in the plate. The plate fastening system may further include a compressible gasket interposed between the underside of the plate and the supporting wall.

8 Claims, 6 Drawing Figures

PLATE FASTENING SYSTEM

BACKGROUND OF THE INVENTION

Field of the Invention

The present invention relates to a new and useful improvement in fastening systems adapted to be used in many applications, in particular large dehumidification systems, to permit the quick and easy release of access panels or the like.

Access panels on large dehumidification systems are required to be removed periodically for inspection and repair purposes. These panels must also seal against air leaks. Time and effort may be expended wastefully by having to remove access panels which are bolted or screwed to supporting or plenum walls of the system.

OBJECTS AND SUMMARY OF THE INVENTION

An object of the present invention is to provide an improved fastening system which allows quick and easy release of access panels or the like.

It is a further object of this invention to provide a fastening device which consists of a minimum number of components and is easily and inexpensively manufactured.

The improved fastening system basically comprises a fastener subassembly which engages an access panel or plate having formed about its periphery a plurality of open-ended slots. The fastener subassembly includes a mounting block which is affixed by fastening means to a plenum or supporting wall of the dehumidification system, a clevis which is pivotally mounted on the block and held in place by a roll pin which extends through the clevis and the mounting block, the plate fastening means adjustably mounted on the clevis to secure the plate to the plenum wall.

Other objects and advantages reside in the details of construction and operation as more fully hereinafter described and claimed, reference being had to the accompanying drawings forming part hereof, wherein like numerals refer to like parts throughout.

DETAILED DESCRIPTION OF THE PREFERRED EMBODIMENT

Figure 1:
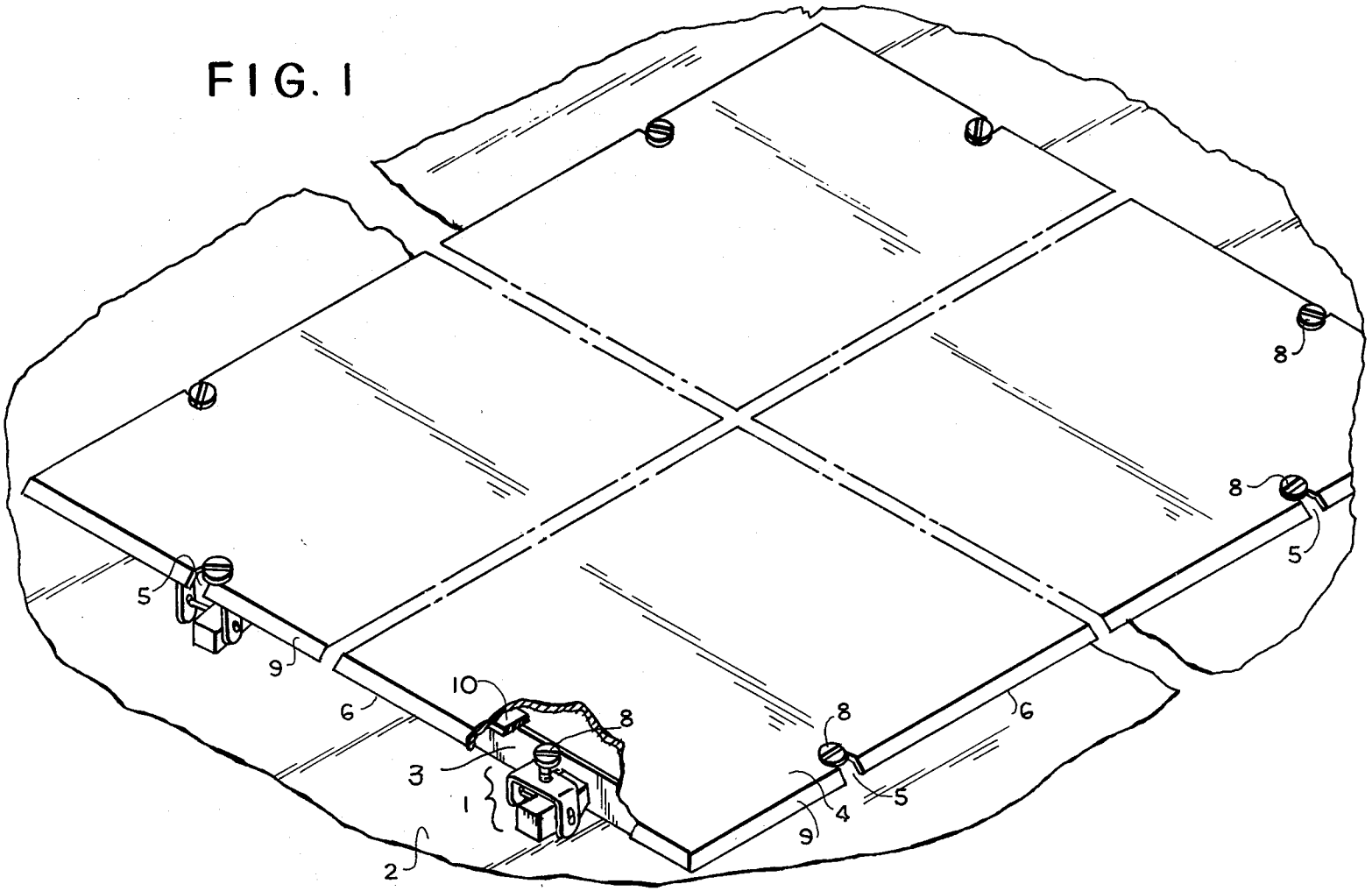
FIG. 1 is a perspective view showing an access panel or plate fastened to a plenum wall by a fastener subassembly.

Referring now to the drawings of the illustrated embodiment and initially to FIG. 1, it will be seen that a plate fastening system comprises a fastener subassembly 1 which is mounted on a supporting or plenum wall 2 and positioned to abut a flange 3 extending perpendicularly from the wall. The fastener subassembly 1 is used to fasten an access panel or plate 4 to plenum wall 2. Plate 4 has formed about its periphery at predetermined locations above each fastener subassembly 1 a plurality of U-shaped slots 5. Each slot 5 is open-ended at the peripheral edge 6 of plate 4. Slot 5 is dimensioned to receive the shank 7 of a machine screw or bolt 8 which projects outwardly from the fastener subassembly 1. The width of slot 5 is limited to prevent the head of machine screw 8 from slipping therethrough. Plate 4 may have a lip 9 about its periphery which is angled downwardly toward plenum wall 2. With lip 9, screw 8 need not be loosened substantially to swing clear of edge 6; this facilitates the removal of plate 4. If an airtight seal is required, a compressible gasket 10 may be interposed between flange 3 of plenum wall 2 and the underside of plate 4. When plate 4 is secured to plenum wall 2, the edge of flange 3 compresses a portion of gasket 10 whereby forming an airtight seal.

Figure 2:
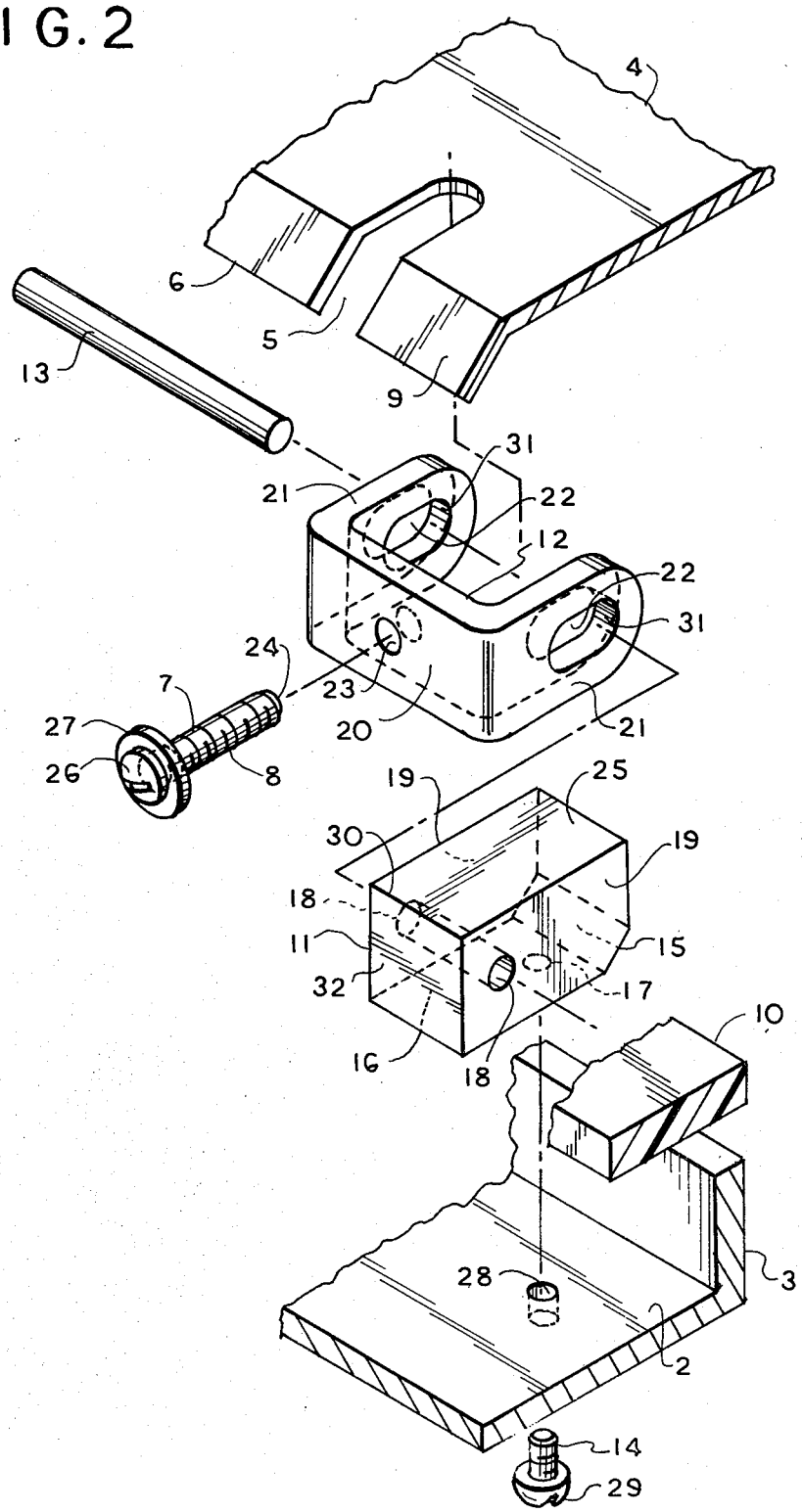
FIG. 2 is an exploded view of the fastener subassembly showing its position in relation to the access panel and the plenum wall.

In FIG. 2 it is seen that fastener subassembly 1 comprises preferrably a rectangular mounting block 11, a clevis 12 surrounding a portion of mounting block 11 and pivotally mounted thereon, a roll pin 13 inserted through openings formed in clevis 12 and mounting block 11, and machine screws 8 and 14.

Mounting block 11 is of solid material and rectangular in shape. An edge 15 thereof is chamferred at preferably a 45° angle and faces the corner formed by flange 3 and plenum wall 2. Formed in the underside 16 of mounting block 11 is an opening 17 dimensioned and threaded to receive machine screw 14. Machine screw 14, which has a slotted round head 29 and which is inserted through a hole 28 formed in plenum wall 2, is used to anchor mounting block 11 in position on plenum wall 2. A circular hole 18 extends through mounting block 11 to side faces 19, its central axis disposed perpendicularly to the planes in which side faces 19 lie. Hole 18 is dimensioned to closely receive and hold roll pin 13 in position.

Clevis 12 includes a main body portion 20 and a pair of mutually parallel legs 21 extending in the same direction from opposite edges of main body portion 20 and substantially perpendicular thereto. In each leg 21 is formed an elongated opening 22 which is oval in shape. Each elongated opening 22 has a width measured along its minor axis which is greater than the diameter of roll pin 13, allowing clevis 12 to receive roll pin 13 through legs 21 and partially rotate about the axis of roll pin 13. The elongated length of opening 22 provides sufficient play for radial movement of clevis 12 in respect to the axis of roll pin 13. Centrally formed in main body portion 20 is a circular opening 23 which is dimensioned and threaded to receive the shank 7 of machine screw 8. Opening 23 extends through the thickness of main body portion 20 so that the tip 24 of machine screw 8 may contact the top side 25 of mounting block 11 when plate 4 is secured to plenum wall 2. Machine screw 8 has a slotted binder head 26 and is fitted with a nylon washer 27.

When fastener subassembly 1 is assembled, as shown in FIGS. 3–6, it can be seen that clevis 12 is pivotally mounted on mounting block 11 and held in place by roll pin 13.

Figure 3:
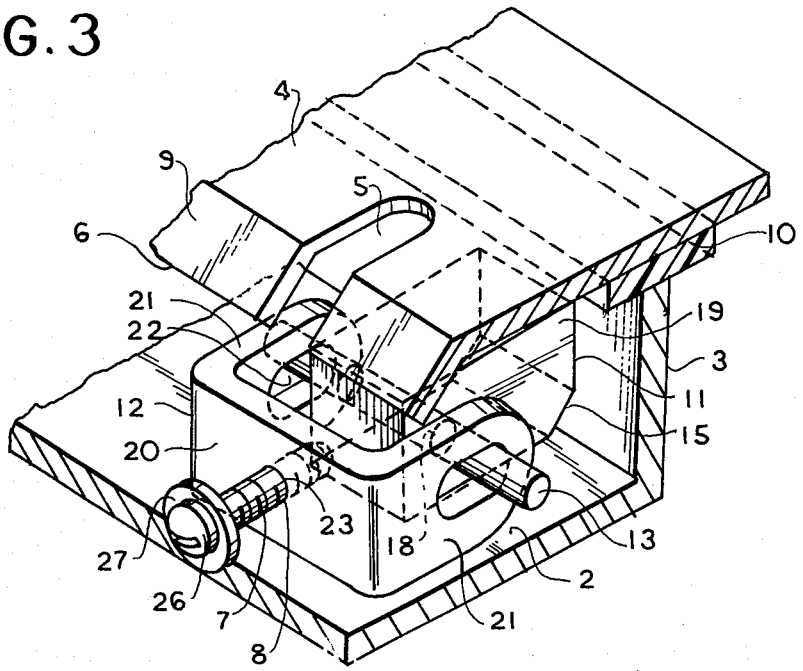
FIG. 3 is a perspective view of the fastener subassembly disengaged from the access panel.
Figure 4:
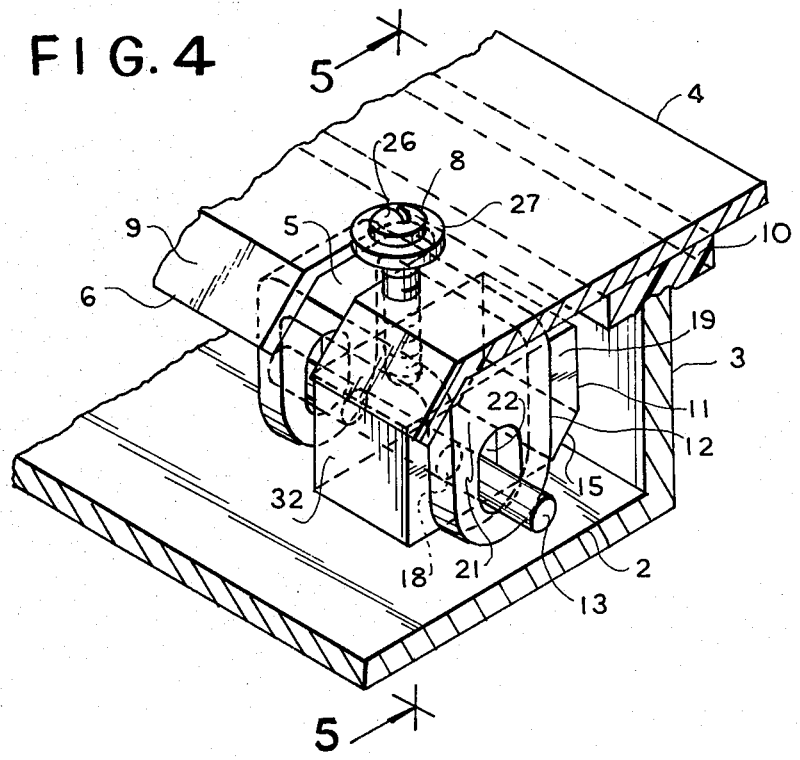
FIG. 4 is a perspective view of the fastener subassembly engaging the access panel to secure the same to the plenum wall.
Figure 5:
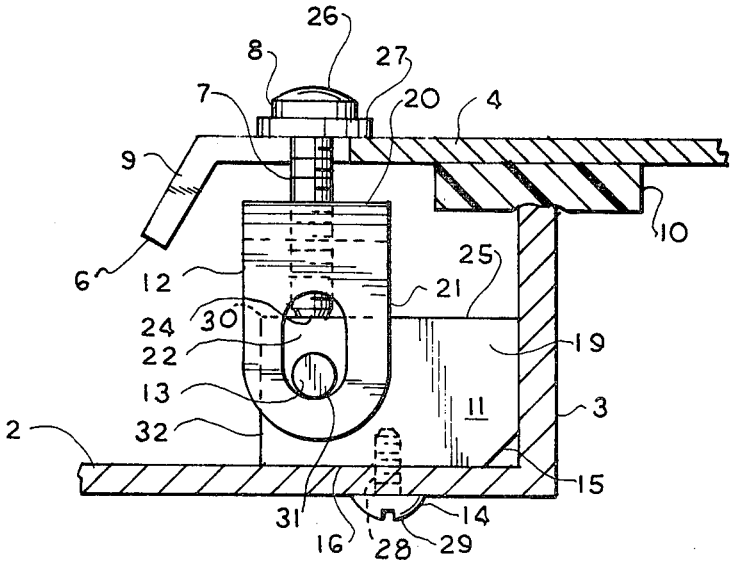
FIG. 5 is a sectional view taken along line 5—5 of FIG. 4.

To remove plate 4 machine screw 8 is loosened. As shown in FIGS. 3–5 with a plenum wall and access panel in a horizontal position, the weight of clevis 12 and screw 8 and the free play provided clevis 12 by elongated openings 22 causes clevis 12 to travel radially toward roll pin 13. This allows tip 24 of screw 8 to remain in contact with the top side 25 of mounting block 11 and support clevis 12 in an upright position. Screw 8 remains in its respective U-shaped plate slot 5 with head 26 resting on the surface of plate 4. Thus, machine screw 8 remains in a stable position even when partially loosened and does not wobble or slide within the plate slot; this greatly facilitates removal of the access panel. When loosened, machine screw 8 may be lifted so that tip 24 no longer contacts top side 25 of block 11. Machine screw 8 may then be swung clear of plate edge 6 with tip 24 clearing the corner 30 of mounting block 11. Clevis 12 will rest on its side, as shown in FIG. 3, and plate 4 may then be removed.

To fasten plate 4 to plenum wall 2, loosened machine screw 8 is inserted into its respective U-shaped plate slot 5 and tightened. Tip 24 contacts top side 25 of mounting block 11 and forces clevis 12 to move radially away from roll pin 13 until the rounded inner edge 31 of elongated opening 22 contacts roll pin 13. This will secure plate 4 to wall 2. If an airtight seal is desired, tightening screw 8 will force the edge of flange 3 of plenum wall 2 to contact and compress a portion of gasket 10.

Figure 6:
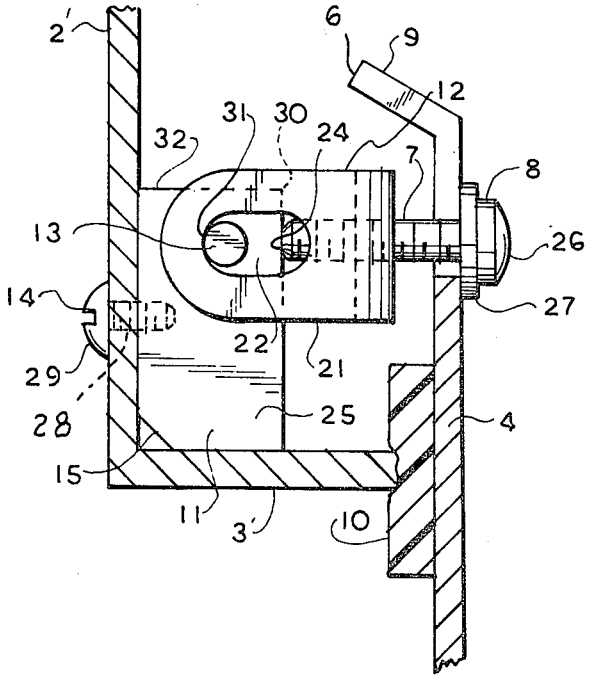
FIG. 6 is a sectional view of the fastener subassembly securing an access panel to a vertically disposed plenum wall.

FIG. 6 shows a plenum wall 2' (with a flange 3') and plate 4 in a vertical position. It should be noted that when fastener subassembly 1 is loosened so that plate 4 can be removed, clevis 12 and machine screw 8 will remain in a vertically upright position. This is because elongated opening 22 allows tip 24 of machine screw 8 to rest on the outer face 32 of mounting block 11 and support clevis 12 and screw 8 in such position.

The preceding description is intended to be illustrative rather than limiting. Various changes and modifications in the embodiments described herein may be effected by one skilled in the art without departing from the spirit and scope of the invention, as defined in the appended claims.

What is claimed is:

1. A plate fastener for removably fastening a plate having open-ended slots formed about its periphery to a supporting wall, which comprises:

means for mounting said plate fastener to the supporting wall, said mounting means including a rectangularly shaped block;

a clevis pivotally mounted on said mounting means, said clevis having a main body portion and a pair of legs extending in the same direction from opposite sides of said main body portion and substantially perpendicular thereto, each leg having an elongated opening formed therein which extends longitudinally with respect to the legs;

means adjustably mounted on said clevis for fastening the plate to said clevis, said plate fastening means cooperating with a respective U-shaped slot of the plate, the plate fastening means including a bolt which is received by and extends through a threaded bore formed in the main body portion of the clevis, the bolt including a broadened head portion at one end thereof, the bolt cooperating with one of the sides of the block so that, when the plate fastener is in a tightened state, the end of the bolt opposite the head portion contacts and exerts sufficient pressure on the side of the block to cause the plate to be wedged and held between the head portion of the bolt and the main body portion of the clevis, and, when the plate fastener is in a loosened state, the end of the bolt opposite the head portion is capable of resting in contact with one of the sides of the block to support the bolt in an upright, stable position; and means for pivotally mounting said clevis to said mounting means, said clevis mounting means extending through said leg openings of said clevis and into openings formed on opposite sides of said mounting means.

2. A plate fastener for removably fastening a plate having open-ended slots formed about its periphery to a supporting wall as defined in claim 1 wherein the supporting wall includes a flange extending angularly therefrom and the rectangularly shaped block of said mounting means has a chamferred edge which faces a corner formed by the supporting wall and the flange.

3. A plate fastener for removably fastening a plate having open-ended slots formed about its periphery to a supporting wall as defined in claim 1 wherein a compressible gasket is interposed between the underside of the plate and the supporting wall.

4. A plate fastener as defined in claim 1 wherein said clevis mounting means is a roll pin.

5. A plate fastener as defined in claim 1 wherein said plate fastening means comprises a slotted binder head machine screw and said main body portion of said clevis has formed therein an opening dimensioned to receive said binder head machine screw.

6. A plate fastener as defined in claim 5 wherein said plate fastening means further comprises a washer dimensioned to fit onto said slotted binder head machine screw.

7. A plate fastener for removably fastening a plate having open-ended slots formed about its periphery to a supporting wall as defined in claim 1 wherein the plate has formed about its periphery a lip angled downwardly toward the supporting wall.

8. A plate fastener for removably fastening a plate having open-ended slots formed about its periphery to a supporting wall as defined in claim 1 wherein said mounting means further comprises a machine screw to mount said mounting means to said supporting wall, said supporting wall having formed therein an opening through which said machine screw extends, the block of said mounting means having formed in a side thereof adjacent the supporting wall an opening into which said machine screw at least partially extends.

* * * * *